United States Patent [19]

Furrow

[11] Patent Number: 4,840,157

[45] Date of Patent: Jun. 20, 1989

[54] ENGINE SPEED CONTROL CIRCUIT FOR DRAG RACING

[76] Inventor: Robert E. Furrow, P.O. Box 338, Hinton, Okla. 73047

[21] Appl. No.: 196,744

[22] Filed: May 20, 1988

[51] Int. Cl.[4] ..... F02D 31/00

[52] U.S. Cl. ..... 123/352; 123/119

[58] Field of Search ..... 123/352, 1 A, 575, 445; 315/209 CD, 209 T

[56] References Cited

U.S. PATENT DOCUMENTS

| | | | |
|---|---|---|---|
| 4,352,402 | 10/1982 | Collonia | 123/352 |
| 4,422,420 | 12/1983 | Cromas et al. | 123/352 |
| 4,425,888 | 1/1984 | Engel et al. | 123/352 |
| 4,494,488 | 1/1985 | Wheatley | 123/1 A |
| 4,546,732 | 10/1985 | Onao et al. | 123/1 A |
| 4,572,140 | 2/1986 | Wheatley | 123/1 A |
| 4,683,843 | 8/1987 | Norcia et al. | 123/1 A |

FOREIGN PATENT DOCUMENTS

| | | | |
|---|---|---|---|
| 0158514 | 12/1979 | Japan | 123/352 |
| 0168038 | 10/1982 | Japan | 123/352 |

*Primary Examiner*—Raymond A. Nelli

*Attorney, Agent, or Firm*—Glen M. Burdick

[57] ABSTRACT

A circuit for decreasing the engine speed of a drag racer for a selected interval during a race has a programmable first down counter for setting the time the interval begins, a programmable second down counter for setting the duration of the interval and a clock connected to both counters.

16 Claims, 4 Drawing Sheets

ENGINE SPEED CONTROL CIRCUIT FOR DRAG RACING

BACKGROUND OF THE INVENTION

1. Field of the Invention

The present invention relates generally to improvements in automotive engine speed control devices and, more particularly but not by way of limitation, to improvements in devices for controlling the speed of operation of drag racer engines.

2. Brief Description of the Prior Art

In the sport of drag racing, the focus is on the time required for a racing car to cover a relatively short distance from a standing start and a race will generally last for a time period of only about ten seconds. Moreover, winning and losing times in such a race will often be separated by only a few hundredths of a second.

This nature of a drag race places a premium on both the reliability of the engine of a racing car and the consistency of operation of the engine from one race to the next. For example, small differences in the ignition of different cylinders in the engine of a drag racer, differences that would go unnoticed in the family automobile, can easily lead to a loss of consistency in the time required to cover a drag race course and make the difference between a racer winning and losing races. In particular, timing of events occurring both in an engine and during a race plays a crucial role in the success of a racing car.

To meet the demands placed on drag racers, inventors have come up with a variety of devices aimed at improving the reliability and consistency of operation of drag racing car engines. One such device, which has proven to be very successful, is the multispark discharge system developed by Automatic Controls Corporation of El Paso, Tex. and disclosed in U.S. Pat. Nos. 3,926,165 and 4,131,100. This system provides a series of sparks to each cylinder during a time period in each cycle of operation of the engine to insure ignition and both the starting point and duration of the time are carefully controlled. Moreover, the system has an engine speed limiting control feature permitting a maximum engine speed to be selected by choice of a resistor that is plugged into the case of the device. Thus, the device provides a means for setting a desired engine speed during a drag race and insuring that the engine will operate in an efficient and consistent manner during a race.

Other attempts to improve the performance of a drag racing car engine have been of lesser success. In particular, devices that have been utilized for "scrubbing off"; i.e., reducing, speed in a race in which the object is to cover a fixed distance in a preselected time with disqualification of any car which covers the course in less than the prescribed time. The cars used in such races are capable of covering the distance in less than the prescribed time and are commonly run at full throttle during the early part of the race and throttled back near the end of the race. An early device used to carry out this race format comprised a switch that closed when the driver shifted from low to drive to activate a solenoid that introduced air into the cylinders of the engine. As a result, the racing car would quickly attain a high speed and then cruise to the end of the race. However, the device proved to be unsuccessful because of inconsistencies in shifting time.

More recently, a device has been developed for scrubbing off speed during a selectable interval in a race. In this device, settable timers are used to select the start and duration of the interval and circuitry is provided to actuate a solenoid connected to a mechanical throttle stop on the engine during the interval. While this device has had some success, the success is limited by expense and reliability problems that often accompany mechanical control devices. Thus, the primary contribution this device has made to the art lies only in the stratagem it employs in the conduct of a race; that is, the scrubbing off of speed during a short time interval in the race with open throttle operation to either side of the interval.

SUMMARY OF THE INVENTION

The present invention provides a circuit that eliminates the disadvantages of mechanical controls while providing the advantages that have been achieved in race strategy with such controls. In particular, the invention takes advantage of the speed limiting feature of the multispark discharge system to scrub off speed during a selected portion of a race. To this end, the invention is comprised of two settable down counters that are operated by a crystal controlled clock to provide two precisely controlled time intervals that are determined by numbers set into the counters in response to signals delivered to loading terminals of the counters. One of these down counters, a second down counter, is used to control the multispark discharge system via changes in a voltage state at a zero count indicator terminal of the second down counter and the other counter, the first down counter, is used to control the operation of the second down counter. In particular, the second down counter is constructed to remain in a zero count state, for which the zero count indicator terminal is in one of two possible voltage states, at all times other than when the second down counter is counting down from a number set thereinto by an electrical pulse at a loading terminal thereof. This loading terminal is connected via a capacitor to a zero count indicator terminal of the first down counter so that the zero count indicator terminal of the second down counter will remain in one of its two states while the first down counter is counting, be switched to the other state upon reception of a pulse via the capacitor from the zero count indicator terminal of the first down counter, and then return to the first state. The circuit further includes a starting switch that controls both the car transmission and the loading of a number into the first down counter so that the two intervals of engine speed operation begin coincidentally with the start of a race.

An object of the present invention is to provide a circuit for temporarily reducing speed of a racing car engine during a time interval that can be selected to start at a precisely determined moment during a race and have a precisely determined duration.

Another object of the invention is to provide a circuit for precisely determining the speed of operation of a racing car engine at diverse times during a race at a low cost to the operator of the racing car.

Yet another object of the invention is to eliminate mechanical unreliability in devices for controlling a race car engine speed while enabling the engine to be operated at more than one speed during a race.

Other objects, features and advantages of the present invention will become apparent from the following detailed description when read in conjunction with the drawings and appended claims.

DESCRIPTION OF THE PREFERRED EMBODIMENT

Figure 1:
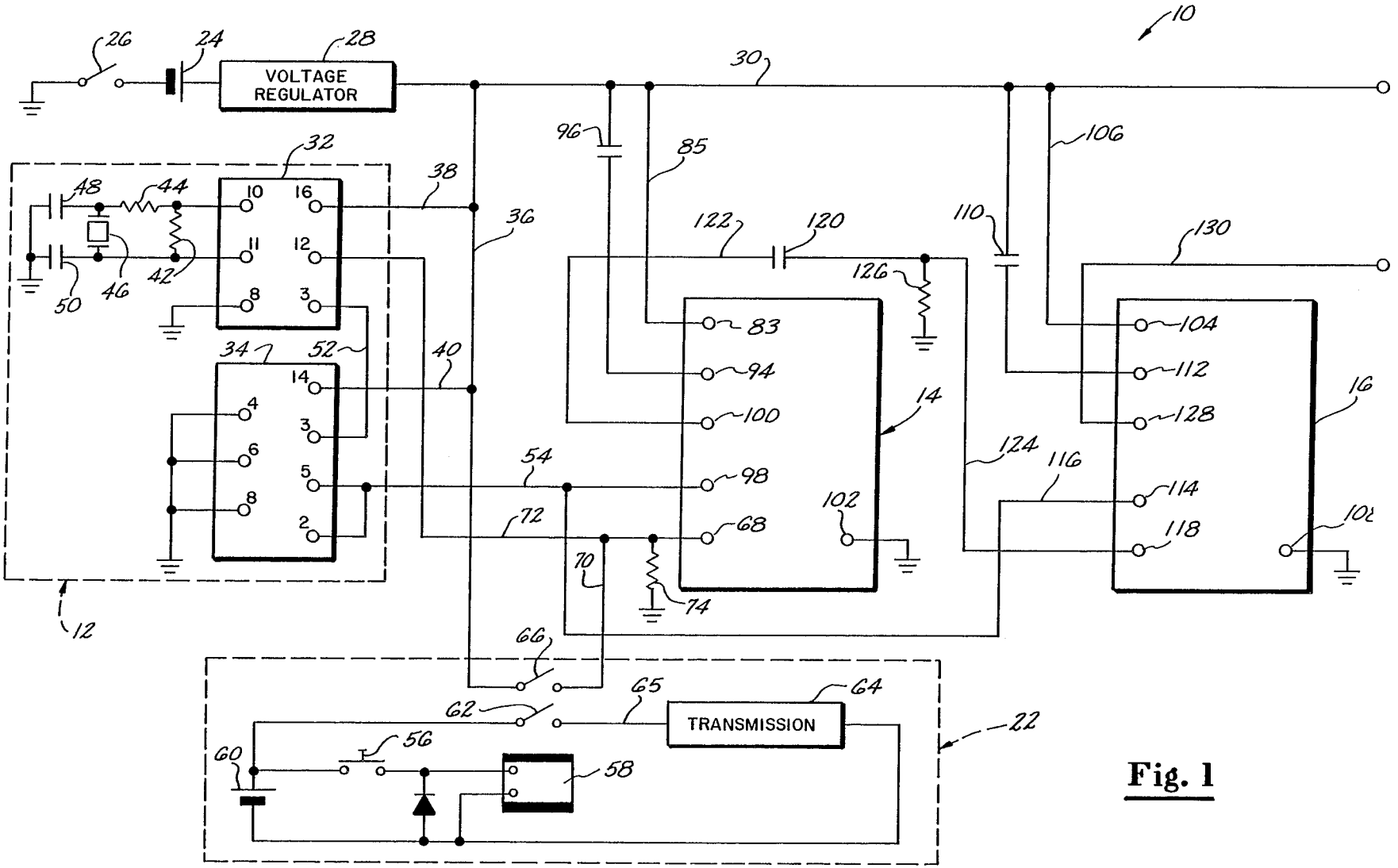
FIG. 1 is a circuit diagram of a portion of the circuit of the present invention illustrating the clocking and counting circuitry.
Figure 2:
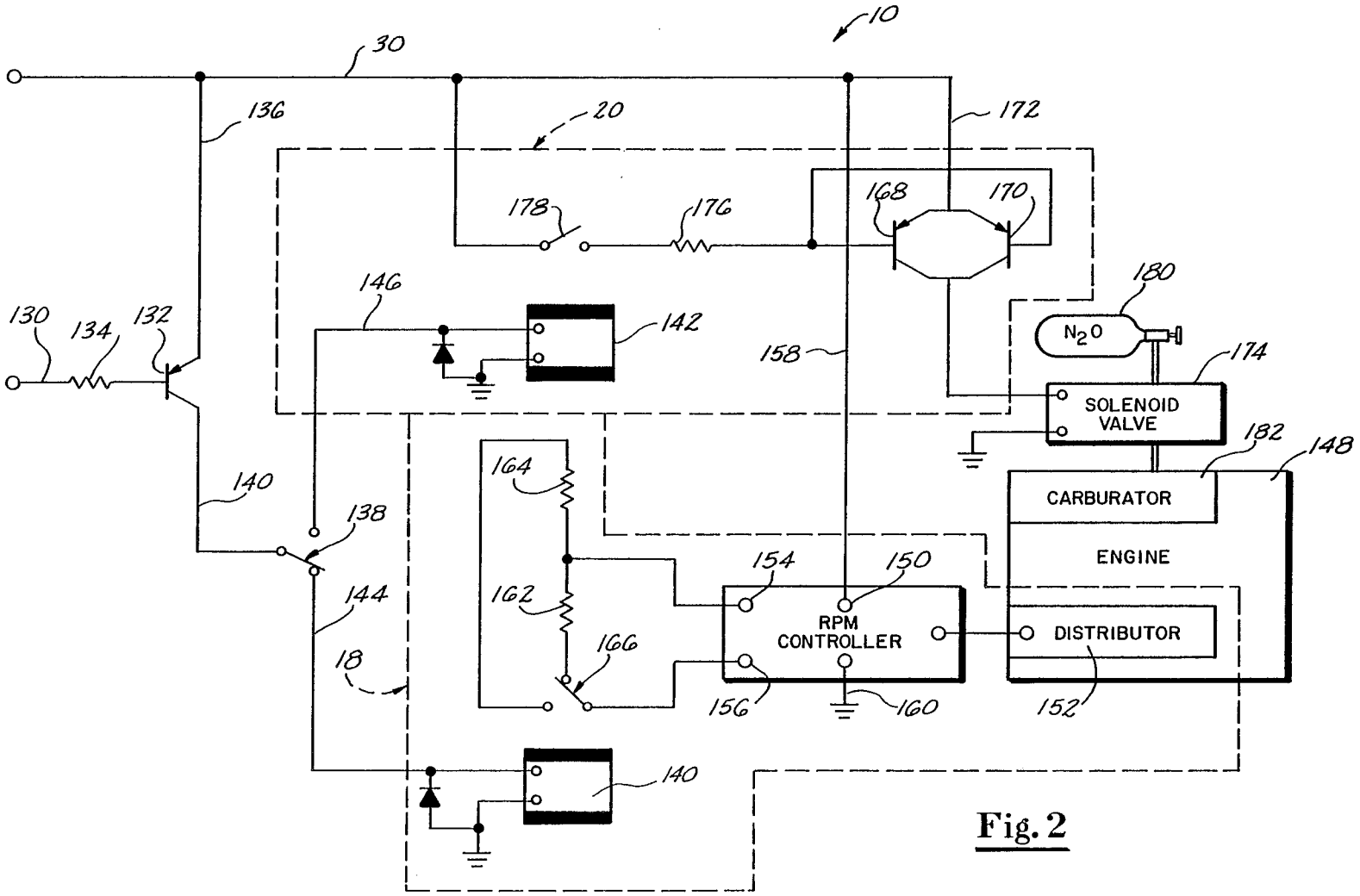
FIG. 2 is a circuit diagram of the remainder of the circuit of the present invention illustrating circuitry for effecting engine speed changes.

Referring now to the drawings in general and to FIGS. 1 and 2 in particular, shown therein and designated by the general reference number 10 is a drag racing car engine control circuit constructed in accordance with the present invention. In general, the circuit 10 is comprised of a crystal regulated clock 12 that is used to clock down first and second down counters, 14 and 16 respectively, during a drag race to temporarily operate a speed adjustment assembly 18 or, alternatively, a solenoid energizing assembly 20 (FIG. 2) during the race for purposes to be disclosed below. A starting assembly 22 is provided to initiate clocking of the down counters 14 and 16 coincidentally with the start of the race so that, as will be discussed below, the time period of operation of the speed adjustment assembly 18 or solenoid energizing assembly 20 can be precisely controlled both with respect to the time the period begins and to the duration of the period. Electrical power for the circuit 10 can be provided by a nine volt battery 24, having a cathode grounded via a power switch 26, and a voltage regulator 28 which provides regulated positive five volt power, relative to the circuit ground, on power line 30.

Referring initially to the clock 12, the clock can conveniently be constructed from commercially available integrated circuits, specifically, the clock 12 can be comprised of a type 4060 fourteen stage ripple counter 32 and half a type 4013 dual D flip-flop 34 having terminals which, for clarity of description, have been numbered with the manufacturer's pin numbers in FIG. 1. Thus, the ripple counter 32 and flip-flop 34 each have a power (Vdd) terminal (manufacturer's pin number 16 for the ripple counter and pin number 14 for the flip-flop 34) which receive power from the power line 32 via conductors 30–40. Similarly, each of the IC's 32 and 34 have a ground (Vss) terminal (manufacturer's pin number 8 for the ripple counter and pin number 7 for the flip-flop) that are connected to the ground for the circuit 10.

In use, the ripple counter 32 is provided with a tuned feedback circuit to form the counter into a square wave oscillator in a manner known in the art. In particular, the feedback circuit is connected across two phase terminals (manufacturer's pin numbers 10 and 11) and is comprised of a 15 megohm resistor 42 in parallel with serially connected 330 kilohm resistor 44 and 3.2768 megahertz crystal 46, a 39 picofarad capacitor 48 between the junction of the resistor 44 and crystal 46 and the system ground, and a 10 picofarad capacitor 50 between the opposite end of the crystal 46 and the circuit ground. With this feedback circuit, the last stage of the binary counter 32 will provide a short electrical pulse at the Q14 output terminal (manufacturer's pin number 3) of the counter 32 once every one two-hundredth of a second. Additionally, the ripple counter 32 has a reset terminal (manufacturer's pin number 12) which is utilized to maintain consistency of operation of the clock 12, and thus of the circuit 10, in a manner to be discussed below.

The pulses provided at the Ql4 output terminal of the ripple counter 32 are transmitted to the clock terminal (manufacturer's pin number 3) of one of the flipflops of the IC 4013 via conductor 52 and the set and reset terminals (manufacturer's pin numbers 6 and 4 respectively) of such flip-flop are grounded resulting, when the data and Q1 inverse output terminals (manufacturer's pin numbers 5 and 2 respectively) of such flip-flop are connected as shown in FIG. 1, in a 100 hertz square wave on a clock line 54. The line 54 provides a continuous stream of clock pulses to the counters 14 and 16 during a drag race as will be discussed below.

Coming now to the starting circuit 22, such circuit is constructed to synchronize the initiation of operation of the circuit 10 with the movement of a racing car using the circuit away from the starting line in a race. To this end, the starting circuit 22 is comprised of a push button switch 56 connected between the coil of a DPST relay 58 and the car battery 60 to energize the relay 58 when the switch 56 is closed. The relay has normally open contacts 62 placed in series with the racing car's transmission 64 via conductor 65 and such transmission is of the type conventionally used in drag racing to engage in the absence of electrical power transmitted thereto on conductor 65 so that the racer will begin to move when the switch 56 is released. As is also conventional, the switch 56 is mounted on the steering wheel of the racing car so that the operator need only raise his thumb to begin his acceleration during a race. A second set of normally open contacts 66 of the relay 58 is serially connected between the circuit power line 30 and a loading terminal 68 of the first down counter 14 via the conductor 36 and conductors 70. 72. Thus, at such times that the switch 56 is held closed by the operator of a racing car, the transmission will be disengaged and a five volt signal will be transmitted to the loading terminal 68 of the first down counter 14 to prevent counting thereby as will be discussed below. Moreover, the conductor 72 is connected to the reset terminal of the ripple counter 32 (manufacturer's pin number 12) so that the ripple counter 32 is being continuously reset while a racer is waiting for the starting signal with the result that the clock 12 will be in the same state at the start of any race to provide a consistency in countdown of the counters 14 and 16 for all races in which a racing car using the circuit 10 might be entered. The reset terminal of the ripple counter 32 and the loading terminal 68 of the first down counter 14 are further connected to a grounded one megohm resistor 74 to permit down counting of the counter 14 by clock pulses on the clock line 54 when the switch 56 is released to open the contacts 66 of the relay 58.

Figure 3:
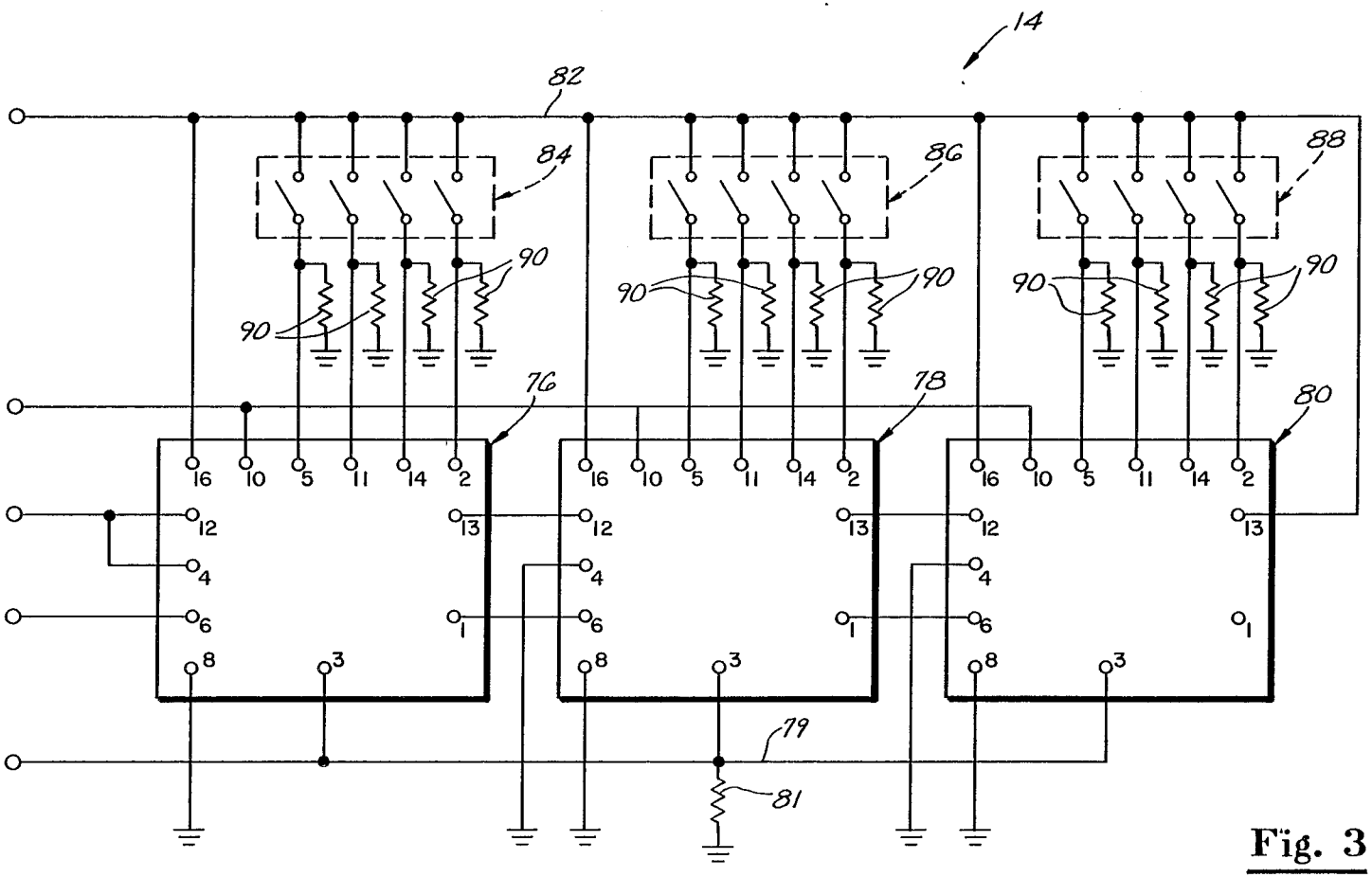
FIG. 3 is a circuit diagram of a preferred counter used in the circuit of the present invention.

The counters 14 and 16 are preferably constructed by cascading type 4522 programmable divide-by-N, four bit BCD counters in a conventional manner that has been illustrated in FIG. 3 for the counter 14 and will now be discussed to provide a basis for an understanding of the operation of the circuit 10. As shown in FIG. 3, the counter 16 is comprised of three type 4522 counters 76–80 into each of which can be entered a number from zero to nine utilizing terminals which, as in the case of the counter 32 and flip-flop 34 of the clock 12, have been identified by the manufacturer's pin numbers. In particular, each of the counters 78–80 is provided with four programming terminals (manufacturer's in numbers 2, 5, 11 and 14) which can be connected to the power line 30 via a conductor 82 which forms a power terminal 83 (FIG. 1) for the counter 14, conductor 85 (FIG. 1), and a rotary switch bank, 84–88 for the counters 76–80 corresponding to BCD representations of digits from zero to nine. Each of the programming terminals of the counters if further connected to the circuit ground via a ten kilohm resistor so that a pattern of voltages corresponding to the BCD representation of any digit from zero to nine can be introduced to the counters at the programming terminals by merely setting the switch banks 84–88. The type 4522 counter is constructed such that the digit expressed by the switch bank connected thereto is entered into the counter and remains therein so long as the counter receives a positive signal at a preset enable terminal (manufacturer's pin number 3) so that the counter 14 can be programmed to count down from a selected three digit number by setting such numbers in the switch banks 84–88 and temporarily applying a positive voltage to the preset enable terminals of the counters 76–80. The preset enable terminals of the counters 76–80 are connected together via a conductor, which is connected to the circuit ground via ten kilohm resistor 81, to form the loading terminal 68 of the down counter 14 so that a preselected three digit number will be entered into the counter 14 while the switch 56 is held closed and will remain therein until the release of the switch 56 at the start of a race.

Each of the type 4522 counters is further provided with a master reset terminal (manufacturer's pin number 10) and the type 4522 counter is constructed to reset; that is, enter the digit zero in response to a positive pulse at the master reset terminal. The master reset terminals of the counters 76–80 are connected together via a conductor 92 that collectively form a reset terminal 94 shown for the counter 14 in FIG. 1. The terminal 94 is connected to the power line 30 via a 0.47 microfarad capacitor so that the counter 76–80 are automatically reset when the circuit is turned on to ensure consistency in day-to-day operation of the circuit 10.

To provide for down counting of the counter 14, each of the type 4522 counters 76–80 has a clock terminal (manufacturer's pin number 6) and the type 4522 counter responds to a clock pulse at its clock terminal by counting down one digit from the number contained therein in the absence of an inhibit signal supplied at an inhibit terminal (manufacturer's pin number 4) thereof. To operate the counters 76–80, the clock terminal of the counter 76 is utilized as a clock terminal 98 (FIG. 1) for the counter 14 and receives clock pulses on the conductor 54 at the rate of one per hundredth of a second. The clock terminal of the counter 78 is connected to a Q4 output terminal (manufacturer's pin number 1) of counter 76 such output terminal providing a positive signal each time counter 76 reaches a zero count so that the counter 78 is clocked at a rate of once every tenth second. Similarly, the clock terminal of the counter 80 is connected to the Q4 output terminal of the counter 78 to receive clock pulses at the rate of one per second. Thus, any time interval of counting from 0.01 to 9.99 seconds can be placed in the counter 14 by setting the seconds digit into the switch bank 88, the tenth seconds digit into the switch bank 86 and the hundredths second digit into the switch bank 84.

The completion of a down count of each of the counters 76–80 is indicated by a zero terminal (manufacturer's pin number 12) that makes a transition to a positive voltage state when a zero count is reached provided that a cascade feedback terminal (manufacturer's pin number 13) is at a high voltage state, the type 4522 continuing the count into the next lower decade in the absence of a positive voltage at the cascade feedback terminal. In the counter 14, the cascade feedback terminal of the type 4522 counter 80 is connected to the conductor 82 so that the zero terminal of the counter will be at a positive voltage at any time that the counter 80 contains the digit zero. The cascade feedback terminal of the counter 78 is connected to the zero terminal of the counter 80 and the cascade feedback terminal of the counter 76 to the zero terminal of the counter 78 so that the zero terminal of the counter 78, which counts tenths of seconds, can become positive only after the number of seconds entered into counter 80 has been counted down and the zero terminal of the counter 76 can become zero only after the tenths of seconds entered into counter 78 has been counted down. Thus, in any counting sequence, the zero terminal of the counter 76, which serves as a zero count indicator terminal 100 for the counter 14 as indicated in FIG. 1, remains in a zero voltage state during counting of a number set into the counter 14 until all three of the counters 76–80 have zeroed out. Counting is then discontinued by connecting the inhibit terminal (manufacturer's pin number 4) of the counter 76 to the zero terminal thereof to inhibit further counting by the counter 76 and, consequently by the counters 78 and 80 which receive clock pulses from the counter 76. The inhibit terminals of the counters 78 and 80 can be connected to the circuit ground as has been indicated in FIG. 3 and electrical power can be provided to the counters 76–80 by connecting a power terminal (manufacturer's pin number 16) to the conductor 82 while connecting a source terminal (manufacturer's pin number 8) to the circuit ground as has been indicated collectively for the counter 14 in FIG. 1 by connecting a ground terminal 100 to the circuit ground in such Figure.

Before continuing with the description of the circuit 10, it will be useful to briefly summarize the operating characteristics of the counter 14. As has been noted above and will be discussed below, an important aspect of the invention is consistency of operation of the circuit 10 from one race to the next and the circuit 10 has been constructed to insure such consistency, in part, by selection of circuit elements and their connection to the counters 14 and 16. As will be clear to those skilled in the art, such selection and connection must be consistent with the characteristics of the counters so that, while the characteristics of the counters do not limit the form the circuit might take, a complete description of the preferred construction of the invention must nevertheless include the characteristics of counters that are used in the preferred construction of the circuit 10.

As will be clear from the description of the counter 14 shown in FIG. 3, the zero count indicator terminal of the counter 14 has two voltage states: a low voltage state that occurs while the counter 14 is down counting and a high voltage state that occurs at all other times so that the zero count indicator terminal 100 will be in the high voltage state following a countdown and following resetting of the counter 14. Moreover, because of the connection between the inhibit and zero terminals of the type 4522 counter 76, the zero count indicator terminal 100 will remain in the high voltage state without regard to clocking of the counter 14 once a countdown has been completed. In particular, at any time that the contents of the type 4522 counter 76–80 has been zeroed, either by resetting of the counters 76–80 or by a countdown, the zero count indicator terminal can be returned to the low voltage state only by a positive voltage applied to the loading terminal 68 that is formed by the totality of reset enable terminals of the type 4522 counters. Thus, once a race is begun by release of the switch 56, the operation of the counter 14 is completely determined and, at the end of such operation, will be in a state that occurs following a reset of the type 4522 counters 76–80 therein. Accordingly, the connection of the reset terminal 94 to the power line 30 via the capacitor 96 to provide a pulse to the reset terminal when the circuit 10 is turned on insures that the state of the counter 14 will be in the same state at the beginning of any race in which the circuit 10 is used.

Returning now to FIG. 1, the second down counter 16 is identical to the first down counter 14. Thus electrical power is supplied to the second down counter 16 via a power terminal 104 connected to power line 30 via conductor 106 and a ground terminal 108 connected to the circuit ground; resetting of the counter 16 when the circuit 10 is turned on is accomplished via a 0.47 microfarad capacitor 110 connected between the power line 30 and a reset terminal 112 of the second counter 16; and clocking of the second counter 16 is effected by connection of a clock terminal 114 of the second down counter 16 to the conductor 54, via conductor 116, that delivers clock pulses to the first down counter 14.

In the practice of the invention, the second down counter 16 is operated subsequently to the operation of the first down counter 14 by providing a voltage pulse to a loading terminal 118 of the second down counter 16, in the same manner that the first down counter 14 is loaded, at the time that the first down counter completes counting down of a number loaded thereinto. To this end, the zero count indicator terminal 100 of the first down counter 14 is connected to the loading terminal 118 of the second down counter 16 via a loading assembly comprised of a 0.1 microfarad capacitor 120, conductors 122 and 124 connected between the capacitor 120 and the terminals 100 and 118, respectively, and a 1 megohm resistor 126 connected between the conductor 124 and the system ground.

In addition to the above terminals, the second down counter 16 has a zero count indicator terminal 128 which, as in the case of the zero count indicator terminal 100, has a low voltage state that occurs while the second down counter is counting and a high voltage that occurs at all other times. A conductor 130 connected to the terminal 112 and shown in both FIGS. 1 and 2, as is the power line 30, transmits the voltage state at the zero count indicator terminal 128 of the second counter 16 to the base of a type 2N3906 pnp transistor 132 via a one megohm resistor 134, both of which are illustrated in FIG. 2 to which attention is now invited.

The emitter of the transistor 132 is connected to the power line 30 via a conductor 136 and the collector of the transistor 132 is connected to the common terminal of a SPDT switch 138 via a conductor 140 and the contacts of the switch 138 are each connected to one terminal of the coils of relays 140 and 142, forming portions of the speed adjustment assembly 18 and solenoid energizing assembly 20, respectively, via conductors 144 and 146. The other terminals of the coils of relays 140 and 142 are grounded so that each such coil can be made the load of the transistor 132 by selection of the position of the switch 138. In either case, since the transistor 132 is a pnp transistor, a high voltage signal at the base thereof at such times that the second down counter is not counting will result in the transistor 132 being in a nonconducting state in which the relay selected by the switch 138 will not be energized. On the other hand, when the second counter 16 is counting, so that its zero count indicator terminal 112 is in a low voltage state, the transistor 132 will conduct to transmit a speed control signal or solenoid energization signal to the relay selected by the switch 138 to energize such relay and change the operation of the racing car engine, that has been schematically represented at 148 in FIG. 2, as will be discussed below.

With continuing reference to FIG. 2, the speed adjustment assembly 18 is comprised of a resistance controlled engine rpm controller 150 that is commercially available from Automatic Controls Corporation of El Paso, Tex. (See also U.S. Pat. Nos. 3,936,165 and 4,131,100) that is electrically connected to the racer distributor 152 and has terminals 154, 156 to which a resistor can be connected to limit the speed of the racer's engine. In the circuit 10, the rpm controller 150 is provided with electrical power from the power line 30 via a conductor 158 and via connection of the controller 150 to the circuit ground a schematically indicated at 160. In order to utilize the controller 150 in the circuit 10, the speed adjustment assembly 18 is further comprised of first and second resistors, 162 and 164, respectively, which are selected to have resistance values specified by Automatic Controls Corporation to limit the speed of the engine 148 to selected values. For example, the resistors can be selected to have values of 7800 ohms and 6700 to limit the engine speed to 9000 rpm and 5000 rpm, respectively. The resistors 162 and 164 re serially connected and across the terminals of a contact assembly 166 of the relay 140 and the terminals 154 and 156 of the controller 150 are connected to the junction of the resistors 162, 164 and the armature of the contact assembly, respectively, so that the first resistor 162, selected to provide a higher engine speed than the second resistor 164, will be connected across the terminal 154, 156 at such times that the relay 140 is de-energized and the second resistor 166 will be connected across the terminals 154, 156 at such times that the relay 140 is energized. Thus, the circuit 10 provides a means of controllably adjusting the engine speed in a preestablished program that is determined by the setting of the switch banks in the first and second down counters 14 and 16.

The solenoid energizing assembly 20 provides the circuit 10 with the additional capacity for increasing the speed of a racing car for a precisely determinable time interval during a drag race. To this end, the solenoid energizing assembly 20 comprises, in addition to the relay 142, a pair of paralleled pnp transistors 168 and 170 having emitters connected to the power line 30 via conductor 172 and collectors connected to one terminal of a solenoid valve 174, the other terminal of which is connected to the system ground so that the solenoid valve 174 can be opened by turning on the transistors 168 and 170. The bases of the transistors 168 and 170 are connected to the power line 30 via a one megohm resistor 176 and normally open contacts 178 of the relay 142 and the solenoid valve 174 is fluidly interposed between a nitrous oxide cylinder 180 and the racing car's carburator 182 so that the circuit 10 can be utilized to inject nitrous oxide into the racing car's engine for a precisely determined time interval set into the counters 14 and 16.

OPERATION OF THE PREFERRED EMBODIMENT

Figure 4:
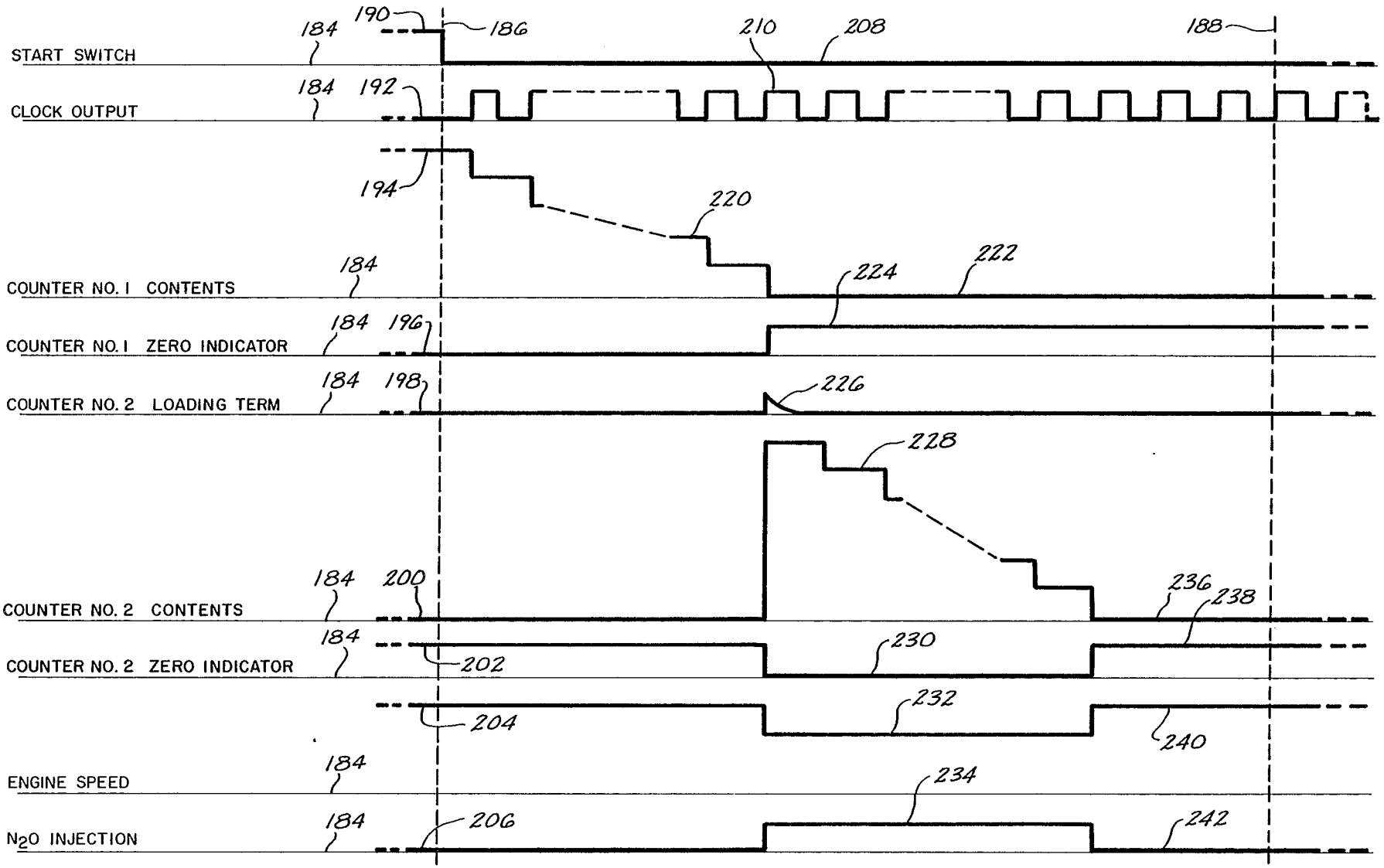
FIG. 4 is a timing diagram illustrating the operation of the circuit of the present invention.

FIG. 4 has been provided to facilitate an understanding of the operation of the circuit 10 by illustrating the series of events, along time lines 184, that takes place from the start of a race, indicated by the dashed vertical line 188. It will be considered that, prior to the race, the racing car will have been brought to the starting line, the circuit 10 will have been turned on, numbers for entry into the counters 14 and 16 will have been set into the switch banks 84–88 thereof and the starting switch 56 will have been depressed while the driver is waiting the signal to start.

When the circuit is turned on, both counters will be reset to zero contents via the capacitors 96 and 110 connected between their reset terminals, 94 and 104, respectively, and the power line 30 so that the zero count indicator terminals of both counters will be in a high voltage state and will remain in such state until numbers have been entered into the counters. When the starting switch is subsequently closed before the beginning of the race, as indicated by the portion 190 of the "Start Switch" line in FIG. 4, the coil of relay 58 is energized to close contacts 82 and 66 thereof so that the racing car's transmission is disengaged and a positive voltage is transmitted to the reset terminal of the ripple counter 32 so that no clock pulses will appear on the circuit clock line 54 as indicated by the portion 192 of the "Clock Output" line of FIG. 4. Additionally, the contacts 66 of the relay 58 will provide a positive voltage at the loading terminal 68 of the first counter 14 so that the number selected by the switch banks 84–88 of the first counter will have been set into the type 4522 counters thereof as indicated by the portion 194 of the "Counter #1 Contents" line in FIG. 4. With the entry of this number into the counter 14, the zero count indicator terminal 100 will have made a transition to a zero voltage state as indicated at 196 on the "Counter #1 Zero Indicator" line in FIG. 4.

Since the loading terminal 118 of the second counter 16 is connected to the zero count indicator terminal 100 of the first counter 14 via the capacitor 120, the voltage at the loading terminal 118 of the second counter 16 will be zero, as indicated at 198 of FIG. 4, and, since loading of the second counter 16 is effected by a positive pulse at the loading terminal 118 thereof, the transition of the zero count indicator terminal of the first counter will leave the contents of the second counter 16 undisturbed at a zero count as indicated at 200 in FIG. 4. In this condition of the second counter 16, the zero count indicator terminal 128 thereof will be in a high voltage state, as shown at 202 in FIG. 4, so that the transistor 132 will be turned off. Thus, if the switch 138 is positioned to provide a conducting path from the transistor 132 to the speed adjustment assembly 18, no signal will be transmitted to the relay 140 and the first resistor 162 will be connected across the terminals 154, 156 of the rpm controller 150 so that the engine 148 will be operating at a relatively high speed selected for the initial portion of the race as indicated at 204 in FIG. 4. If, on the other hand, the switch 138 is positioned to provide a conducting path from the transistor 132 to the solenoid energizing assembly, the lack of conduction by the transistor 132 will result in the relay 142 being in a non-energized state wherein the contacts 178 thereof are open to turn off transistors 168 and 170 and close the solenoid valve 174 so that no nitrous oxide is provided to the carburetor of the engine as indicated at 206 in FIG. 4. Since, with the starting switch 57 closed, the clock 12 is being continually reset, the first counter 14 is continually receiving a positive signal at the loading terminal 68 thereof, and no number has been entered into the type 4522 counters of the second counter 16, the circuit will remain in this state indefinitely while the starting switch is held closed.

When the driver of the racing car receives the signal to commence the race, he releases the starting switch 56 and leaves such switch open for the duration of the race as indicated at 208 in FIG. 4. The release of the switch 56 opens the contact assembly 62 of relay 58 to engage the transmission of the racing car and begin the race. Simultaneously, the contact assembly 66 is opened to remove the voltage transmitted thereby to the reset terminal of the ripple counter 32 so that clock pulses will appear on the clock line one two-hundredth of a second after the release of the switch 56 and at one-hundredth second intervals thereafter as shown at 210 on the "Clock Output" line of FIG. 4. Thus, it will be noted that the connection of the reset terminal of the ripple counter 32 to the contact assembly 66 provides for a consistent time of initiation of clock pulses to the counters 14 and 16 that is maintained from one race to the next insuring that the circuit 10 operates in the same manner in all races in which the circuit 10 might be used. Simultaneously with the release of the resetting voltage at the reset terminal of the ripple counter 32, the voltage at the loading terminal 68 of the first counter drops to zero to permit down counting of the first counter by the clock pulses appearing on the clock line 54. However, since initiation of counting by the first counter 14 will not provide an electrical pulse to the loading terminal 118 of the second counter 16 to load the type 4522 counters of which the second counter 16, the contents of counter #2 will remain at zero, as indicated at 212 on the "Counter #2 Contents" line in FIG. 4. Thus, the zero count indicator terminal 128 of the second counter 16 will remain in the high voltage state, as shown at 214 on the "Counter #2 Zero Indicator" line of FIG. 4, and no change will be made in the operation of the speed adjustment assembly 18 or the solenoid energizing assembly 20. Thus, if the switch 138 has been positioned to provide a conducting path from the transistor 132 to the speed adjustment assembly 18, the racing car will move away from the starting line with the engine 148 operating at a high speed determined by the connection of the first resistor 162 to the rpm controller 150 as indicated at 216 in FIG. 4. If the switch 132 is positioned to operate the solenoid energizing assembly 20, the solenoid valve 174 will remain closed so that the engine leaves the starting line operating on only racing fuel as indicated at 218 in FIG. 4.

As the racing car moves down the race track, the clock pulses at 210 in FIG. 4 will clock down the first counter 14 as at 220 so that, at the end of the time period determined by the number set into the first counter 14 and the clocking rate, the first counter 14 will reach a zero count which, with the continued release of the starting switch 52 to prevent reloading of the first counter 14, will be maintained, as shown at 222 on the "Counter #1 Contents" line of FIG. 4, until the racing car is again positioned for a race. When the first counter reaches a zero count, the zero count indicator terminal 100 thereof will undergo a transition to the high voltage state thereof and such state will be maintained until a signal is again received by the first counter loading terminal; that is, until the next race, as indicated at 224 on the "Counter #1 Zero Indicator" of FIG. 4.

With the transition of the zero count indicator terminal 100 of the first counter 14 to the high voltage state, a momentary positive pulse 226 will be transmitted by the capacitor 120 to the loading terminal 118 of the second counter 16 to enter the number selected by the switch banks 84–88 thereof into the type 4522 counters thereof, as indicated at 228 on the "Counter #2 Contents" line of FIG. 4 so that the zero count indicator terminal 128 of the second counter will go to a low voltage state as indicated at 230 on the "Counter #2 Zero Indicator" line of FIG. 4 and remain in such state during down counting of the second counter 16. Thus, the transistor 132 will undergo a transition to a conducting state that will energize the relay 140 or 142 selected by the switch 138. If the relay 140 of the speed adjustment assembly 18 has been selected, energization of such relay will close contact assembly 166 to place the second resistor 164 across the rpm controller 150 and thereby decrease the speed of the engine 148 as indicated at 232 on the "Engine Speed" line of FIG. 4. Alternatively, if the relay 142 of the solenoid energizing assembly 20 has been selected, the energization of such relay closes contacts 178 thereof to turn on transistors 168 and 170 to energize the solenoid valve 174 and inject nitrous oxide into the carburator of the engine 148 as indicated at 234 on the "$NO_2$ Injection" line of FIG. 4.

As the race continues, the second counter 16 will be clocked down until the contents thereof reach zero and, as shown at 236 in FIG. 4, this content will remain in the second counter 16 until a number is again entered into the counter 16 by a subsequent operation of the first counter 14; that is, until a subsequent race. Thus, it will be seen that the second counter 16 will end a race in the state in which it began the race, a state that also occurs when the circuit 10 is turned on. Thus, since the voltage at the zero count indicator terminal 128 of the second counter 16 determines the operating speed of the engine 148 or the injection of nitrous oxide thereinto in a manner now to be discussed, the circuit 10 will cause the racing car to operate in a manner that is consistently determined for all races in which the racing car might be entered.

When the count in the second counter reaches zero, the zero count indicator terminal 128 thereof will return to the high voltage condition, as indicated at 238 on the "Counter #2 Zero Indicator" line of FIG. 4, to return the relay selected by the switch 132 to its state at the start of the race so that the engine is returned to the high operating speed as indicated at 240 or the injection of nitrous oxide into the engine 148 is terminated as indicated at 242. Thus, the circuit 10 provides a selectable change in the operation of the engine 148 that occurs for a time interval that can be precisely and consistently selected for all races in which a racing car using the circuit 10 might be entered and, further, will return to the state in which it is placed when the circuit is turned on to ensure that the circuit 10 itself will operate in a consistent manner from race to race. Thus, the circuit 10 enables the user thereof to select the mode of operation of the engine of his racing car during any race in which he might be entered and such mode of operation will be consistently carried out for all races he chooses to enter.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A circuit for temporarily reducing the engine speed of a racing car during a drag race, comprising:

a clock for providing a sequence of timed electrical pulses during the drag race;

a first down counter electrically connected to the clock for counting down from a first preselected number entered into the first down counter in response to pulses provided by the clock;

a second down counter electrically connected to the clock for counting down from a second preselected number entered into the second down counter in response to pulses provided by the clock wherein the second down counter is characterized as having a zero count indicator terminal providing the alternative voltage states corresponding to a counting and non-counting condition of the second down counter;

starting means for initiating a countdown of the first down counter from the first preselected number simultaneously with the start of a drag race;

means electrically connecting the down counters for loading the second preselected number into the second down counter at such time that the count in the first down counter reaches zero;

speed adjustment means for adjusting the speed of the racing car engine in response to a speed control signal; and means, connected between the speed adjustment means and the zero count indicator terminal of the second down counter, for providing the speed control signal in response to a selected voltage state at said zero count indicator terminal.

2. The circuit of claim 1 further comprising:

a source of nitrous oxide;

a normally closed solenoid valve connected between the source of nitrous oxide and the carburator of the racing car engine; and means for energizing the solenoid valve in response to an electrical signal corresponding to one of the voltage states of the zero count indicator terminal of the second down counter; and wherein the means for connecting the speed adjustment means to the zero count indicator terminal of the second down counter is further characterized as a means for alternatively connecting the zero count indicator terminal of the second down counter to the speed adjustment means and the means for energizing the solenoid valve.

3. The circuit of claim 2 wherein the clock is characterized as having a reset terminal for providing a time origin for the clock in response to an electrical signal applied to the clock reset terminal and wherein the reset terminal of the clock is connected to the starting means for zeroing the clock at the beginning of each drag race in which the racing car is entered.

4. The circuit of claim 3 wherein the first down counter is characterized as having a zero count indicator terminal providing alternative voltage states corresponding to a counting and a non-counting condition of the first down counter; wherein the second down counter is further characterized as having a loading terminal and is of the type responsive to an electrical pulse provided at the loading terminal for entering the second preselected number into the second down counter; and wherein the means for loading the second preselected number into the second down counter comprises a capacitor connected between the zero count indicator terminal of the first down counter and the loading terminal of the second down counter for transmitting an electrical pulse to the loading terminal of the second down counter in response to a change of voltage state of the zero count indicator terminal of the first down counter.

5. The circuit of claim 3 wherein the speed adjustment means comprises:

a resistance controlled engine rpm controller;

a first resistor connectable to the engine rpm controller for limiting the engine speed to a first preselected value;

a second resistor connectable to the engine rpm controller for limiting the engine speed to a second preselected value; and a relay having a coil connected to the means for providing the speed control signal for energization of the relay thereby and a contact assembly electrically connected between the engine rpm controller and the resistors for connecting the first resistor to the engine rpm controller in a de-energized state of the relay and for connecting the second resistor to the engine rpm controller in an energized state of the relay.

6. The circuit of claim 3 further comprising means for resetting both counters at such time that electrical power is applied to the current.

7. The circuit of claim 2 wherein the first down counter is characterized as having a zero count indicator terminal providing alternative voltage states corresponding to a counting and a non-counting condition of the first down counter; wherein the second down counter is further characterized as having a loading terminal and is of the type responsive to an electrical pulse provided at the loading terminal for entering the second preselected number into the second down counter; and wherein the means for loading the second preselected number into the second down counter comprises a capacitor connected between the zero count indicator terminal of the first down counter and the loading terminal of the second down counter for transmitting an electrical pulse to the loading terminal of the second down counter in response to a change of voltage state of the zero count indicator terminal of the first down counter.

8. The circuit of claim 2 wherein the means for adjusting the speed of the racing car engine in accordance with the voltage state of the zero count indicator terminal of the second down counter comprises:

a resistance controlled engine rpm controller;

a first resistor connectable to the engine rpm controller for limiting the engine speed to a first preselected value;

a second resistor connectable to the engine rpm controller for limiting the engine speed to a second preselected value; and a relay having a coil connected to the means for providing the speed control signal for energization of the relay thereby and a contact assembly electrically connected between the engine rpm controller and the resistors for connecting the first resistor to the engine rpm controller in a de-energized state of the relay and for connecting the second resistor to the engine rpm controller in an energized state of the relay.

9. The circuit of claim 2 further comprising means for resetting both counters at such time that electrical power is applied to the circuit.

10. The circuit of claim 1 wherein the clock is characterized as having a reset terminal for providing a time origin for the clock in response to an electrical signal applied to the clock reset terminal and wherein the reset terminal of the clock is connected to the starting means for zeroing the clock at the beginning of each drag race in which the racing car is entered.

11. The circuit of claim 10 wherein the first down counter is characterized as having a zero count indicator terminal providing alternative voltage states corresponding to a counting and a non-counting condition of the first down counter; wherein the second down counter is further characterized as having a loading terminal and is of the type responsive to an electrical pulse provided at the loading terminal for entering the second preselected number into the second down counter; and wherein the means for loading the second preselected number into the second down counter comprises a capacitor connected between the zero count indicator terminal of the first down counter and the loading terminal of the second down counter for transmitting an electrical pulse to the loading terminal of the second down counter in response to a change of voltage state of the zero count indicator terminal of the first down counter.

12. The circuit of claim 10 wherein the means for adjusting the speed of the racing car engine in accordance with the voltage state of the zero count indicator terminal of the second down counter comprises:

a resistance controlled engine rpm controller;

a first resistor connectable to the engine rpm controller for limiting the engine speed to a first preselected value;

a second resistor connectable to the engine rpm controller for limiting the engine speed to a second preselected value; and a relay having a coil connected to the means for providing the speed control signal for energization of the relay thereby and a contact assembly electrically connected between the engine rpm controller and the resistors for connecting the first resistor to the engine rpm controller in a de-energized state of the relay and for connecting the second resistor to the engine rpm controller in an energized state of the relay.

13. The circuit of claim 10 further comprising means for resetting both counters at such time that electrical power is applied to the circuit.

14. The circuit of claim 1 wherein the first down counter is characterized as having a zero count indicator terminal providing alternative voltage states corresponding to a counting and a non-counting condition of the first down counter; wherein the second down counter is further characterized as having a loading terminal and is of the type responsive to an electrical pulse provided at the loading terminal for entering the second preselected number into the second down counter; and wherein the means for loading the second preselected number into the second down counter .comprises a capacitor connected between the zero count indicator terminal of the first down counter and the loading terminal of the second down counter for transmitting an electrical pulse to the loading terminal of the second down counter in response to a change of voltage state of the zero count indicator terminal of the first down counter.

15. The circuit of claim 1 wherein the means for adjusting the speed of the racing car engine in accordance with the voltage state of the zero count indicator terminal of the second down counter comprises:

a resistance controlled engine rpm controller;

a first resistor connectable to the engine rpm controller for limiting the engine speed to a first preselected value;

a second resistor connectable to the engine rpm controller for limiting the engine speed to a second preselected value; and a relay having a coil connected to the means for providing the speed control signal for energization of the relay thereby and a contact assembly electrically connected between the engine rpm controller and the resistors for connecting the first resistor to the engine rpm controller in a de-energized state of the relay and for connecting the second resistor to the engine rpm controller in an energized state of the relay.

16. The circuit of claim 1 further comprising means for resetting both counters at such time that electrical power is applied to the circuit.

* * * * *